US007849725B1

(12) United States Patent
Nelson et al.

(10) Patent No.: US 7,849,725 B1
(45) Date of Patent: Dec. 14, 2010

(54) AIR CANNON APPARATUS AND SYSTEM FOR GOLF BALL TESTING

(76) Inventors: Anthony A. Nelson, 4211 38th St. West, Bradenton, FL (US) 34205; Dennis M. Schreiner, 171 Grainger Rd., Unit 169, Medina, OH (US) 44256

( * ) Notice: Subject to any disclaimer, the term of this patent is extended or adjusted under 35 U.S.C. 154(b) by 0 days.

(21) Appl. No.: 12/360,581

(22) Filed: Jan. 27, 2009

(51) Int. Cl.
*G01M 9/06* (2006.01)

(52) U.S. Cl. ..... 73/12.05; 73/12.07; 73/65.03

(58) Field of Classification Search ..... 73/12.04, 73/12.05, 12.07, 65.03
See application file for complete search history.

(56) References Cited

U.S. PATENT DOCUMENTS

| | | | | |
|---|---|---|---|---|
| 3,288,127 | A * | 11/1966 | Bullock | 124/73 |
| 3,572,309 | A | 3/1971 | DeFreitas | |
| 3,662,729 | A * | 5/1972 | Henderson | 124/73 |
| 3,938,272 | A | 2/1976 | Ditto et al. | |
| 5,471,383 | A | 11/1995 | Gobush et al. | |
| 5,497,650 | A | 3/1996 | Chien | |
| 5,769,066 | A * | 6/1998 | Schneider | 124/75 |
| 6,186,002 | B1 * | 2/2001 | Lieberman et al. | 73/432.1 |
| 6,285,445 | B1 * | 9/2001 | Winfield et al. | 356/28 |
| 6,286,364 | B1 * | 9/2001 | Aoyama et al. | 73/65.03 |
| 6,415,671 | B1 * | 7/2002 | Chien | 73/865.9 |
| 6,416,428 | B1 | 7/2002 | Tygar et al. | |
| 6,443,140 | B1 * | 9/2002 | Crews et al. | 124/78 |
| 6,547,671 | B1 | 4/2003 | Mihran | |
| 6,571,600 | B2 | 6/2003 | Bissonnette et al. | |
| 6,644,294 | B2 | 11/2003 | Christensen | |
| 6,749,528 | B2 * | 6/2004 | Wengert | 473/409 |
| 6,758,759 | B2 | 7/2004 | Gobush et al. | |
| 6,781,621 | B1 | 8/2004 | Gobush et al. | |
| 6,804,988 | B2 | 10/2004 | McNamara et al. | |
| 6,923,039 | B2 | 8/2005 | Bissonnette et al. | |
| 7,150,178 | B2 | 12/2006 | Bissonnette et al. | |
| 7,166,035 | B2 | 1/2007 | Voges et al. | |
| 2007/0060410 | A1 | 3/2007 | Gobush | |
| 2008/0021651 | A1 | 1/2008 | Seeley et al. | |

OTHER PUBLICATIONS (Servo) Motor Controller (Part # 5-599) Specification. Milford Instruments Limited. Dec. 12, 2004. pp. 1-4.*

* cited by examiner

*Primary Examiner*—Lisa M Caputo
*Assistant Examiner*—Punam Roy
(74) *Attorney, Agent, or Firm*—Charles J. Prescott

(57) ABSTRACT

An air cannon apparatus and system for test launching golf balls. The apparatus includes a barrel sized to slidably receive a golf ball, an air pressure tank coupled to the barrel by an air control valve, a golf ball air clamp assembly for holding a golf ball for rotation about a spin axis within and transverse to the barrel, and a servomotor coupled to the air clamp assembly for controlledly spinning the golf ball prior to launching. The air control valve releases a charge of pressurized air from the air pressure tank into the barrel against the spinning golf ball simultaneous with releasing the clamp whereupon the golf ball is launched from the barrel. The system also includes a frame assembly for lockable positioning of the apparatus at a selected inclination angle and a system controller. The apparatus is selectively rotatable to vary the angular orientation of the spin axis.

1 Claim, 6 Drawing Sheets

AIR CANNON APPARATUS AND SYSTEM FOR GOLF BALL TESTING

CROSS-REFERENCE TO RELATED APPLICATIONS

Not applicable

STATEMENT REGARDING FEDERALLY SPONSORED RESEARCH OR DEVELOPMENT

Not applicable

INCORPORATION-BY-REFERENCE OF MATERIAL SUBMITTED ON A COMPACT DISC

Not applicable

BACKGROUND OF THE INVENTION

1. Field of the Invention

This invention relates generally to golf equipment and more specifically to an air cannon apparatus and system which tests the flight and roll performance of a broad array of golf balls to achieve optimal golf ball distance and consistency.

2. Description of Related Art

Systems for golf ball fitting are well known. Conventional methods for finding the best golf ball for a golfer derive from the golfer actually playing rounds of golf with different brands and then deciding which brand is best. Obviously this method has its faults. Not only is it extremely time consuming but it can be very expensive. Another method for golf ball selection is to go to a retail store and go through a ball fitting system. Most of these systems are designed by the golf ball manufacturers and are only applicable to the brands they make. Still another method is to categorize golfers based upon their ability levels and then lump them into categories matching specific brands.

Four patents assigned to Acushnet Company, invented by Bissonnette, et al. disclose general golf ball testing machines and methods for measurement of Coefficient Of Restitution (COR) and contact time of golf balls. U.S. Pat. No. 6,571,600 teaching an apparatus and method for quantifying the stiffness of a golf ball or COR, while also measuring contact time. The apparatus is an air cannon providing means for velocity measurement. U.S. Pat. No. 6,804,988 discloses an automated machine for testing physical properties of golf balls and U.S. Pat. No. 6,923,039 discloses the method and apparatus for measuring the coefficient of restitution of a golf ball following simulated hitting by an actual golf club. The '178 patent is a continuation of the '988 and '600 patents.

Christensen discloses a golf ball projecting air cannon capable of projecting a golf ball or paint ball beyond 100 yards in U.S. Pat. No. 6,644,294. Tygar, et al. discloses a pneumatic golf ball launching device in U.S. Pat. No. 6,416,428.

A performance assessment and information system is taught by Seeley, et al. in U.S. published application 2008/0021651 which is designed to measure, calculate, derive and analyze the ball movement and ball-oriented characteristics in order to provide an assessment of the player's performance. Chien in U.S. Pat. No. 5,497,650 teaches a pneumatic golf club testing apparatus which projects a golf ball at a fixed golf club head.

U.S. Pat. No. 6,547,671 to Mihran teaches a device for providing for the accurate determination of the launch angle of a golf ball after being struck by a golf ball. Voges, et al. teaches systems and methods using advanced technology for identifying the optimum equipment for a golfer in U.S. Pat. No. 7,166,035. Gobush describes a method and apparatus for measuring ball launch conditions in U.S. published application 2007/0060410.

Since all golfers are unique in their swing characteristics it is most important to determine how that unique swing impacts the golf ball. The golf ball speed, golf ball spin rate and the golf ball launch angle immediately upon impact are the most critical pieces of information needed to determine how a golf ball will perform. With the development of golf launch monitors it is now readily available for golfers to gather this data. It was necessary to develop a database system to compare a plurality of golf balls based on this available data. A testing method was established to compare these golf balls against one another at various tests. To insure complete accuracy in testing specialized testing equipment had to be built to perform exacting tests. A centrifugal force rotary robot was designed to perform impact tests.

An air cannon system was designed to conduct golf ball aerodynamic performance testing. This air cannon is the subject of this patent application. A pendulum-putting machine was also designed to conduct putting tests. Other equipment that is standard to the golf industry such as durometers, compression testers, chronographs and launch monitors were used in testing. Traditional robots and air cannons common to the golf industry could not be used to conduct tests. Golf robots such as "Iron Byron" are designed to swing golf clubs and simulate a real golfers swing. The problem is their inability to generate the same exact strike on the golf ball each time. The inconsistency in shaft bending and impact locations on the golf face will skew golf ball comparison studies. Therefore a pendulum type centrifuge was designed to swing in a perfect circle allowing for the golf ball to be struck in the same exact location every time. The speed can be controlled through a servomotor and the launch angle can be altered via the hitting blocks attached to the end of the shaft. An air cannon system had to be designed that could shoot the golf balls at various speeds, launch angles and spin rates without the impact of a golf club. Since the amount of times a golf ball can be struck with a golf club is limited before damage occurs, a no impact device had to be designed. This equipment is necessary to develop the golf ball comparison testing databases. Finally it is known that all golf balls within a given brand do not perform exactly the same. This is true because of manufacturing tolerances. Therefore it is necessary to not only determine which brand is best for a golfer but then that brand should be tested for consistency.

Another invention of applicants herein which is the subject of a separate pending patent application is directed to a method of matching a golfer's skills to a particular brand of golf balls by first testing a golfer's skills using a golf launch monitor, the data derived from this test being entered into an extensive computerized system of research databases. Further test results are taken for putting comparisons between all brands within the system. A final category known as "the feel index" is also tested and entered into the computer database. Based upon the results and golfer preference towards distance, accuracy, putting and feel, the top brand is selected for that person. This brand is then subjected to a series of air cannon tests to determine the performance characteristics of each ball. The balls are then subdivided into groups and performance rated for consistency.

The foregoing examples of the related art and limitations related therewith are intended to be illustrative and not exclusive. Other limitations of the related art will become apparent to those skilled in the art upon a reading of the specification and a study of the drawings.

BRIEF SUMMARY OF THE INVENTION

Overview

The purpose of this golf ball cannon apparatus and system is to replicate the flight of golf balls when struck by a golfer. The air cannon apparatus is capable or creating any ball speed from a minimum of 35 MPH to a high speed of 185 MPH. The angle of launch can be adjusted from a low of 0 degrees to a high of 45 degrees and the spin rate can be set with a low value of 0 RPM's to a high value of 10,000 RPM's. The air cannon apparatus can also be rotated on its axis to generate sidespin from a low value of 0 RPM's to a high value of 10,000 RPM's in either direction, left or right which will allow for slicing and hooking patterns. These parameters will allow the air cannon apparatus to duplicate the flight pattern of virtually any golf shot that can be created by a human being. The concept is to be able to shoot a default brand golf ball at various launch angles, spin rates and ball speeds to determine the flight characteristics of that brand. This information will be useful in developing ball fitting and club fitting systems. The air cannon apparatus can also be used to check golf balls for consistency. The data generated from the cannon can be useful in creating optimum flight modules to help golfers improve their games.

The air cannon apparatus uses pneumatic air pressure to propel the golf ball. The ball is held inside the barrel by a specially clamping device that is powered by pneumatics. The same device is used to spin the golf ball to create backspin. This is powered by a servomotor. An electronic actuator is used to open and close a ball valve to allow for the release of air to propel the golf ball from the barrel. A regulator is used to moderate the amount of air pressure which controls the speed of the golf ball. The barrel is adjusted vertically to create the desired launch angle. The air cannon apparatus is then rotated on its axis to the desired degree to create the desired amount of sidespin.

The entire system runs off a smart motor interface controller that adjusts the controls of all the devices. The controller is set to clamp the golf ball, then turn on the servomotor, bring the ball speed to the desired setting, then simultaneously relax the ball clamp and open the ball valve to allow the air to flow against the golf ball thus propelling the spinning ball from the barrel. The ball then passes through a speed trap or chronograph upon exiting the barrel to measure the exact ball speed.

The air cannon testing is the most critical part of testing methodology. The golf balls are placed in the barrel of an air cannon in various positions. The cannon is adjustable to create virtually any ball speed, launch angle and spin rate that can be created by a golfer. A series of tests are conducted at various ball speeds, launch angles and spin rates to develop a database for carry distance, total distance and accuracy for each brand based on the launch angle, spin rate and ball speed parameters. These balls are shot outdoors onto a field that is lined and measured. A technician in the field charts the exact landing point for each golf ball. The carry distance, carry offline distance; total distance with roll and total offline distance with roll are also measured and recorded. Weather conditions including temperature, humidity, wind direction and wind speed are recorded for each shot. Comparison testing must be conducted in common weather conditions so as not to skew results. Wind speed cannot exceed 3 MPH or it will affect the ball flight.

This data is used to develop a three dimensional "look up" database of total distance, carry distance, and offline accuracy for the software program.

Example

Test Parameters of Ball Speed
150 MPH, Launch Angle 12.25 Degrees, Spin Rate 3500 RPM

| Golf Ball Brand | Carry Dist. yds | Total Dist. yds | Accuracy Off Line yds |
|---|---|---|---|
| Bridgestone B-330 (Default Ball) | 240.5 | 254.9 | 2.34 |
| Titlesist Pro V1 | 237.2 | 250.3 | 1.11 |
| Wilson Hope | 226.2 | 235.8 | 5.12 |

How the Air Cannon Works

The air cannon apparatus software is opened with a laptop computer. The desired spin rate for the golf test being conducted is entered into the software. That speed setting will remain constant through the entire test. The air pressure is set for the cannon. The air passes through a regulator and the pressure is set. Air pressure controls the amount of pressure applied to the golf ball. This will propel the ball at a desired speed based upon the setting.

The fire button is then pressed. Immediately the ball clamps move inside the barrel and close, grabbing the golf ball. The servo controller then sends a speed signal to the servomotor and the motor spins at that desired setting e.g. 3500 RPM's. Once the servomotor reaches the desired speed a second signal is sent to the air clamps allowing them to relax the grip on the golf ball. Simultaneously a $3^{rd}$ command is sent to the electronic ball valve. This allows for the valve to open and a direct blast of air is imparted on the golf ball.

The golf ball then is propelled out of the barrel at the desired ball speed, launch angle and backspin rate for that specific test. This procedure is repeated for each and every brand. The distance results for each shot are recorded by a field technician.

While a number of exemplary aspects and embodiments have been discussed above, those of skill in the art will recognize certain modifications, permeations and additions and subcombinations thereof. It is therefore intended that the following appended claims and claims hereinafter introduced are interpreted to include all such modifications, permeations, additions and subcombinations that are within their true spirit and scope.

The following embodiments and aspects thereof are described and illustrated in conjunction with systems, tools and methods which are meant to be exemplary and illustrative and not limiting in scope. In various embodiments one or more of the above-described problems have been reduced or eliminated while other embodiments are directed to other improvements. In addition to the exemplary aspects and embodiments described above, further aspects and embodiments will become apparent by reference to the drawings and by study of the following descriptions.

Exemplary embodiments are illustrated in reference figures of the drawings. It is intended that the embodiments and figures disclosed herein are to be considered to be illustrative rather than limiting.

DETAILED DESCRIPTION OF THE INVENTION

| List of components | |
|---|---|
| 10. | golf ball test launching system |
| 12. | air cannon apparatus |
| 14. | system controller housing |
| 16. | air compressor |
| 18. | frame assembly |
| 20. | laptop computer |
| 22. | air tank |
| 24. | air release solenoid |
| 26. | barrel collet |
| 28. | barrel |
| 30. | air tank support |
| 32. | launch angle axis |
| 34. | launch angle adjust plate |
| 36. | system controller circuit |
| 38. | system air pressure regulator |
| 40. | ball clamp air pressure regulator |
| 42. | servo motor |
| 44. | ball clamp air line |
| 46. | ball clamp air line |
| 48. | servo spin shaft |
| 50. | rotating shaft |
| 52. | driven golf ball support cup |
| 54. | free spinning golf ball support cup |
| 56. | barrel insert |
| 58. | support |
| 60. | support |
| 62. | barrel axis |
| 64. | golf ball spin axis indicator |
| 66. | launch angle indicator |
| 68. | front support |
| 70. | rear support |
| 72. | chronograph |
| 74. | golf ball spin axis |
| 76. | ball clamp assembly |
| 78. | launch angle locking handle |
| 80. | collet support |
| 82. | system start switch |
| 84. | angle pointer |
| A | tilt air cannon |
| B | rotate cannon about barrel axis |
| C | clamp golf ball |
| C' | release golf ball |
| D | servo spin direction |
| E | compressed air discharge |
| F | load golf ball |
| G | golf ball |

Figure 1:
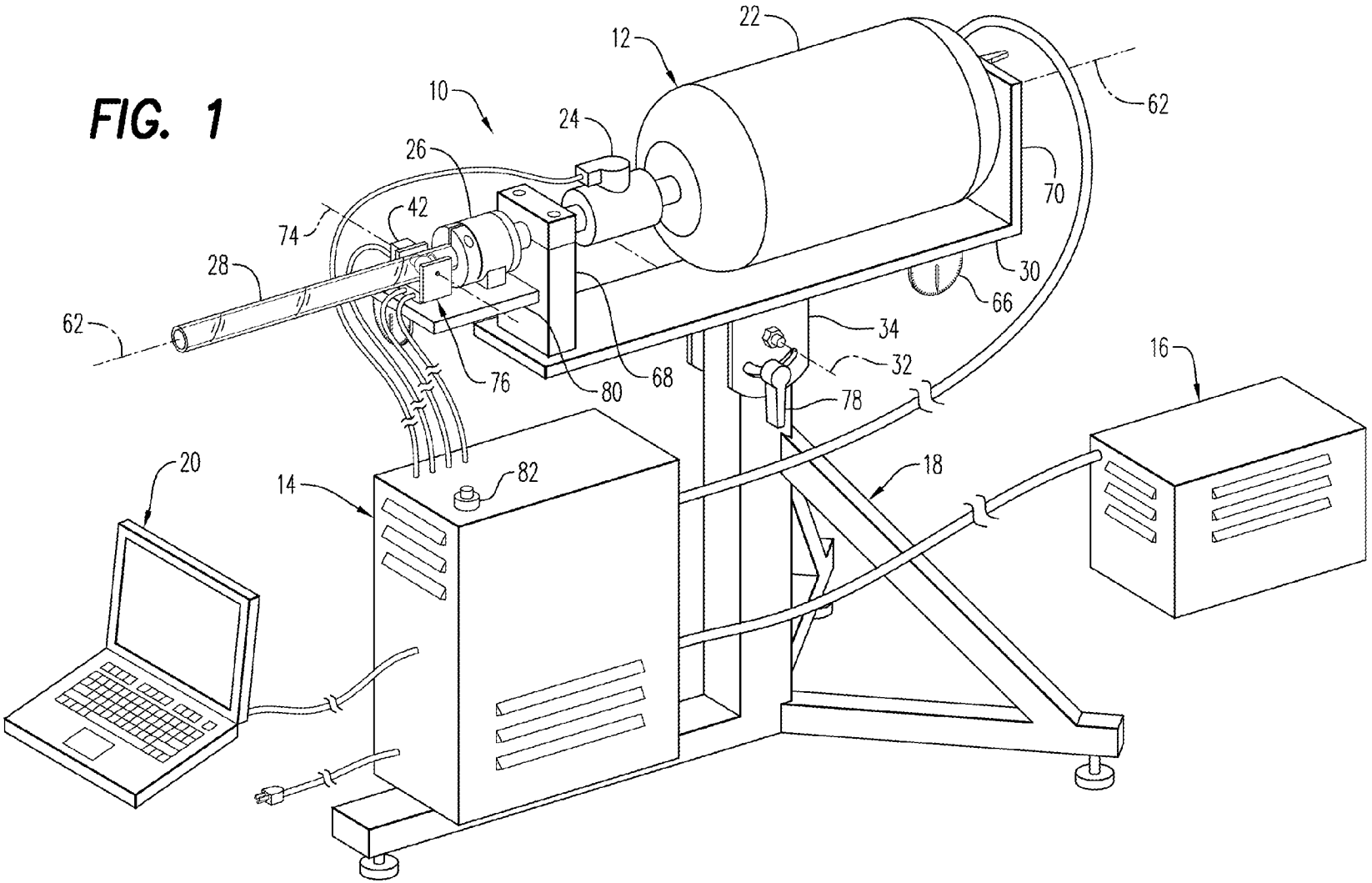
FIG. 1 is a perspective view of the entire system of the present invention.
Figure 2:
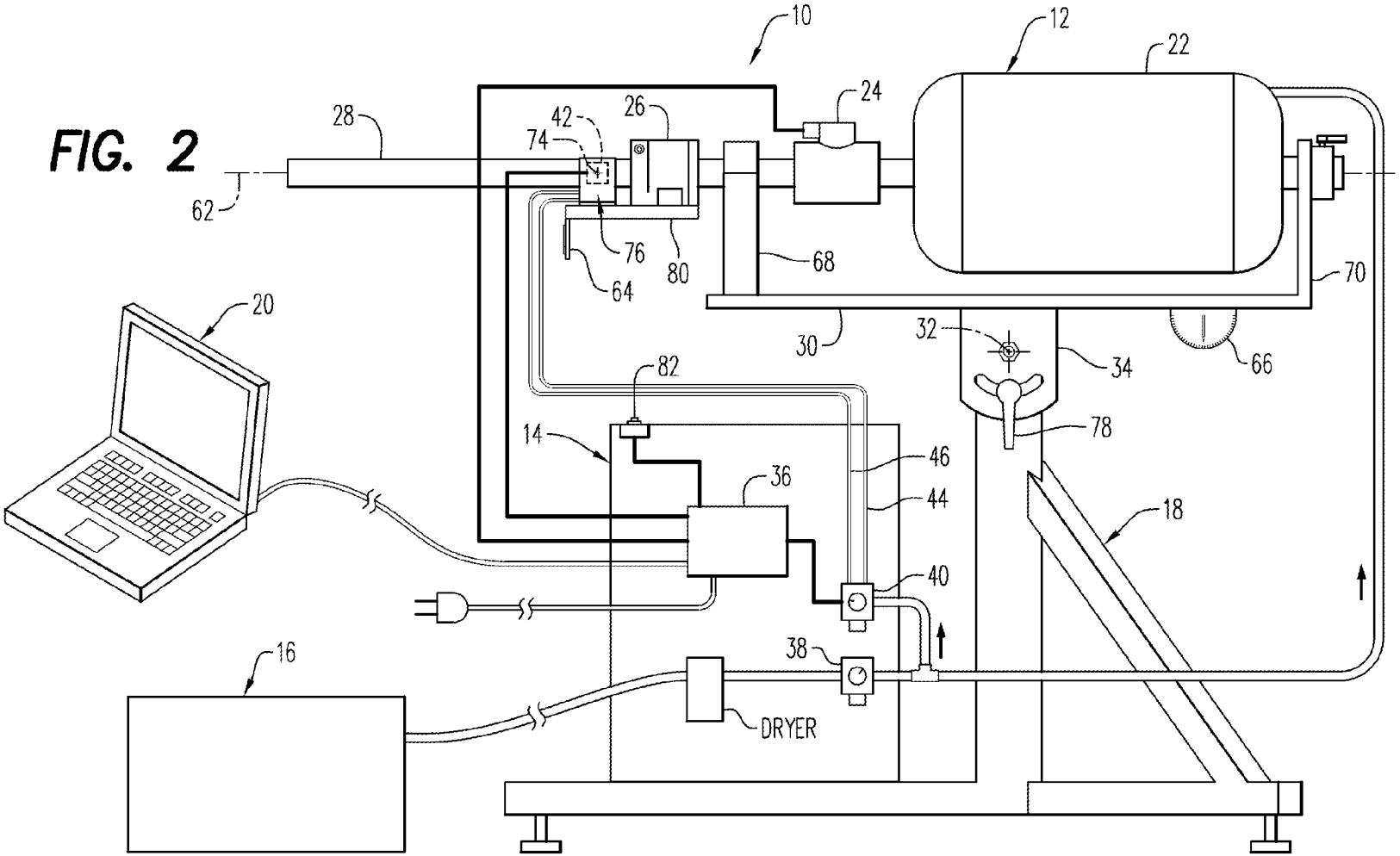
FIG. 2 is a side elevation simplified view of FIG. 1.
Figure 3:
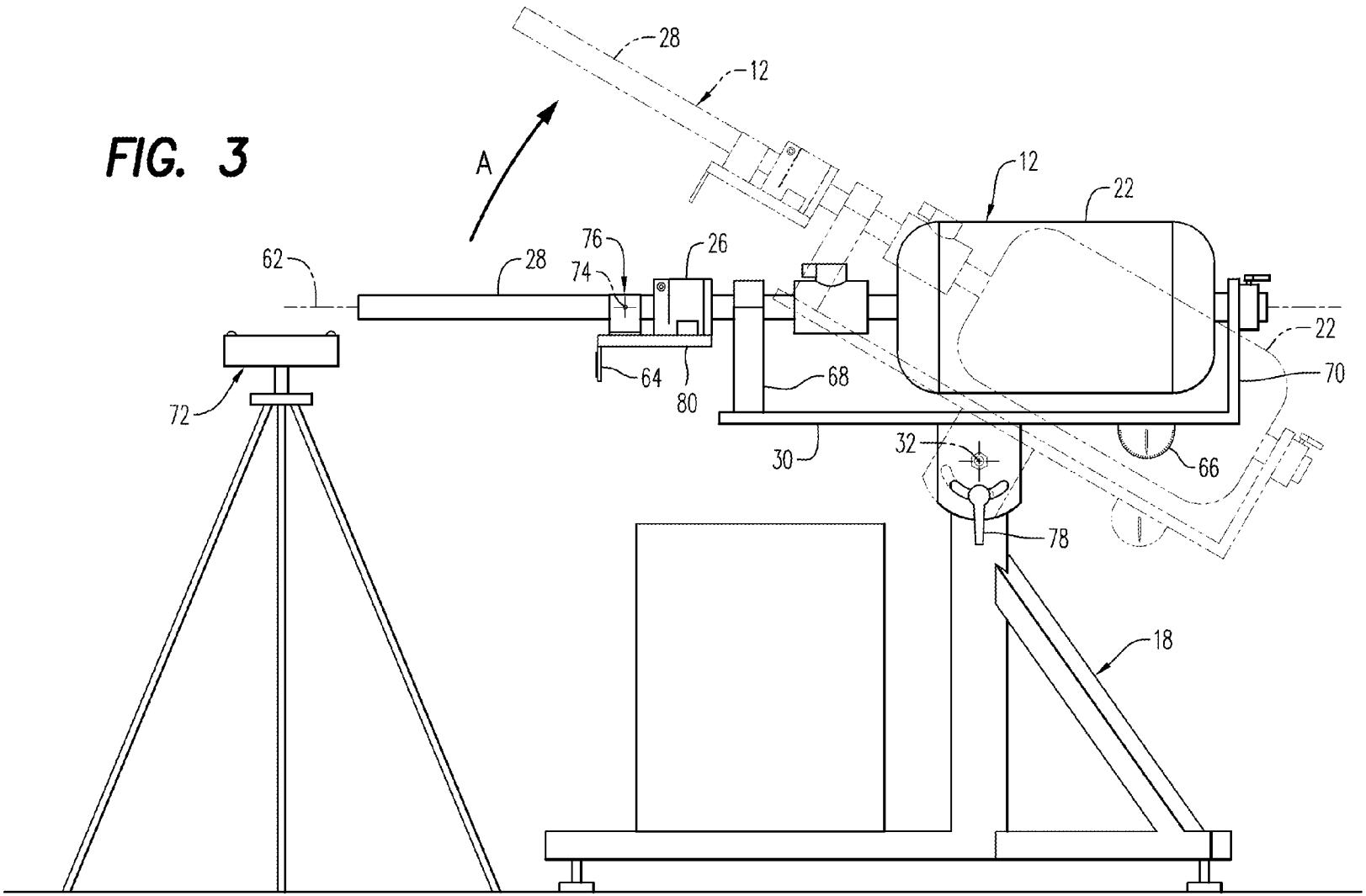
FIG. 3 is another simplified side elevation view of FIG. 1 including a chronograph and depicting the adjustable inclination of the air cannon apparatus 12 in phantom.

Referring now to the drawings, and firstly to FIGS. 1 to 3, the golf ball test launching system is there shown generally at numeral 10 and includes an air cannon apparatus 12, a system controller within housing 14, an air compressor 16, a frame assembly 18, and a laptop computer 20. The air cannon apparatus 12 includes a compressed air storage tank 22 which is supported on an air tank support 30 having spaced front and rear supports 68 and 70, respectively. An air release solenoid 24 is positioned between the air tank 22 and the front support 68.

The air cannon apparatus 12 also includes an elongated tubular barrel 28 open at a distal end thereof and extending along a longitudinal axis 62 thereof. The proximal end portion of the barrel 28 is held within a split barrel collet 26 and supported within the front support 68 extending to the solenoid 24. A collet support 80, which supports the collet 26, also supports a ball clamp assembly 76 which will be described more fully herebelow.

The air cannon apparatus 12 is, in its entirety, pivotally connected about a launch angle axis 32 to the upright member of frame assembly 18 by this pivotal connection therebetween. When the launch angle locking handle 78 is loosened, the air cannon apparatus 12 and air tank support 30 are pivotally movable in the direction of arrow A about the launch angle axis 32 into an inclined position shown in phantom in FIG. 3. A launch angle indicator 66 attached to the air tank support 30 provides a viewable indicia as to the currently selected inclination of the air cannon apparatus 12.

As seen in FIG. 2 schematically, the air compressor 16 provides a source of pressurized air flowing through an air dryer firstly and then into a system air pressure regulator 38. Compressed air at the selected pressure will then flow in the direction of the arrows into the air tank 22 and also into a ball clamp air pressure regulator 40. The reduced pressurized air will then flow from the regulator 40 into the ball clamp air lines 44 and 46 and into the ball clamp assembly 76, the functionally of which will be described in more detail herebelow.

Still referring to FIG. 2, a system control circuit 36 mounted within the system controller housing 14 shown in FIG. 1, receives system control input from a programmed laptop computer 20. Control signals are then sent from the controller circuit 36(*a*) to the regulator 40 which regulates the operation of the ball clamp assembly 76, (*b*) to the solenoid 24 which controls the pressure and volume discharge of pressurized air from air tank 22, (*c*) regulates the functioning of the ball clamp assembly 76 and (*d*) receives start and stop commands from the system start switch 82.

Figure 4:
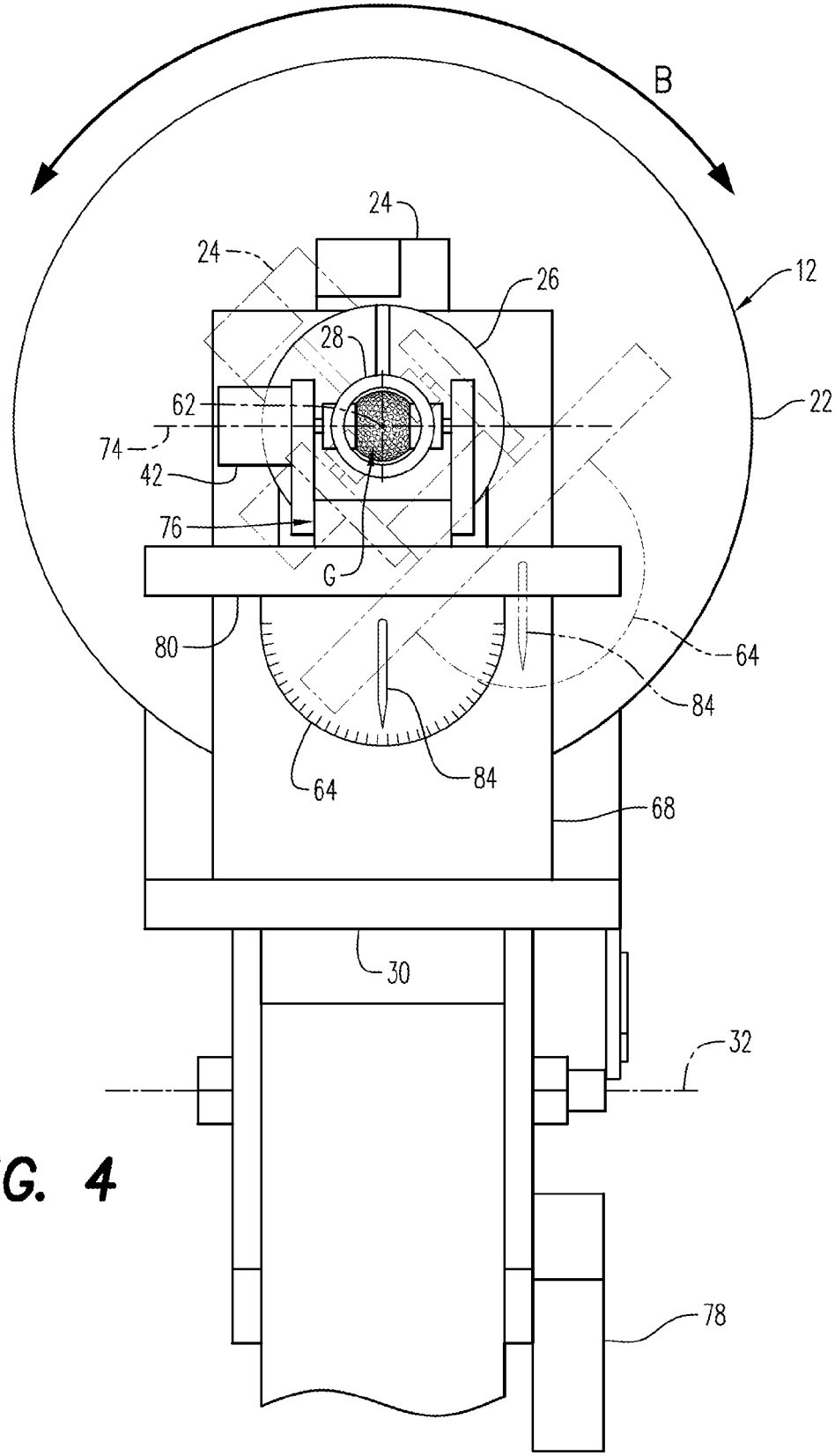
FIG. 4 is a left end enlarged view of FIG. 1 depicting rotation of the air cannon apparatus about the longitudinal axis of the barrel.

Referring additionally to FIG. 4, the air cannon apparatus 12 is rotatable about the barrel axis 62 when the barrel collet 26 has been loosened. The ball clamp assembly 76 defines a golf ball spin axis 74 which extends transversely therethrough and through the golf ball G. It is this spin axis 74 which is tilted in one direction or the other from horizontal in the direction of arrow B when the entire air cannon apparatus 12 is thus rotated. A golf ball spin axis indicator 64, in combination with the gravity-pivotable pointer 84 provides visual indicia as to the selected orientation of the spin axis 74 selected as shown in phantom.

Figure 5:
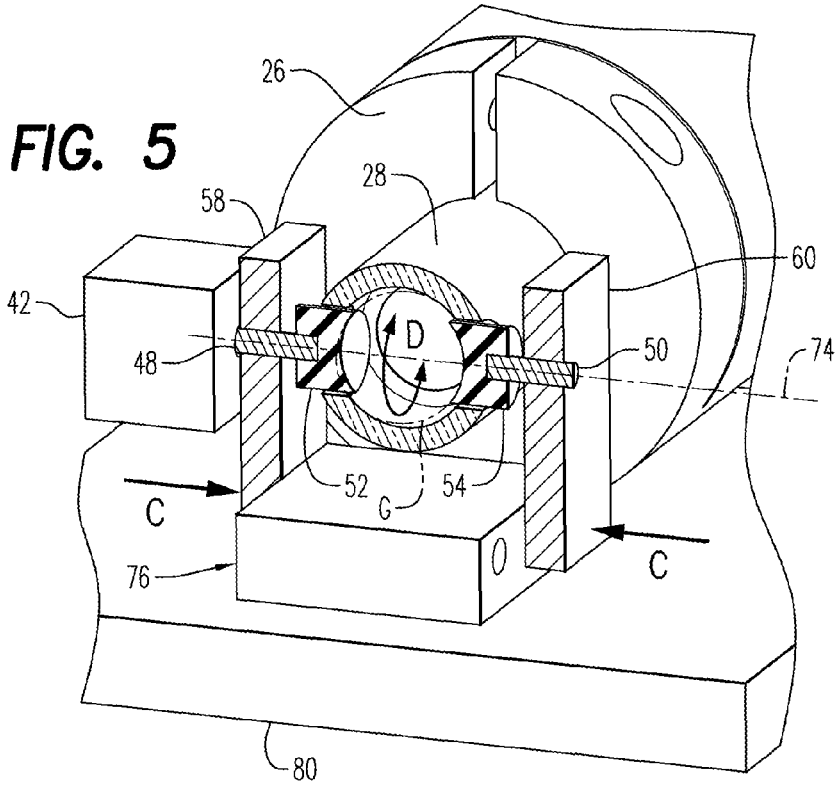
FIG. 5 is a perspective broken view of FIG. 4 depicting the pneumatic ball clamp assembly vis-a-vis the proximal end portion of the barrel.
Figure 6:
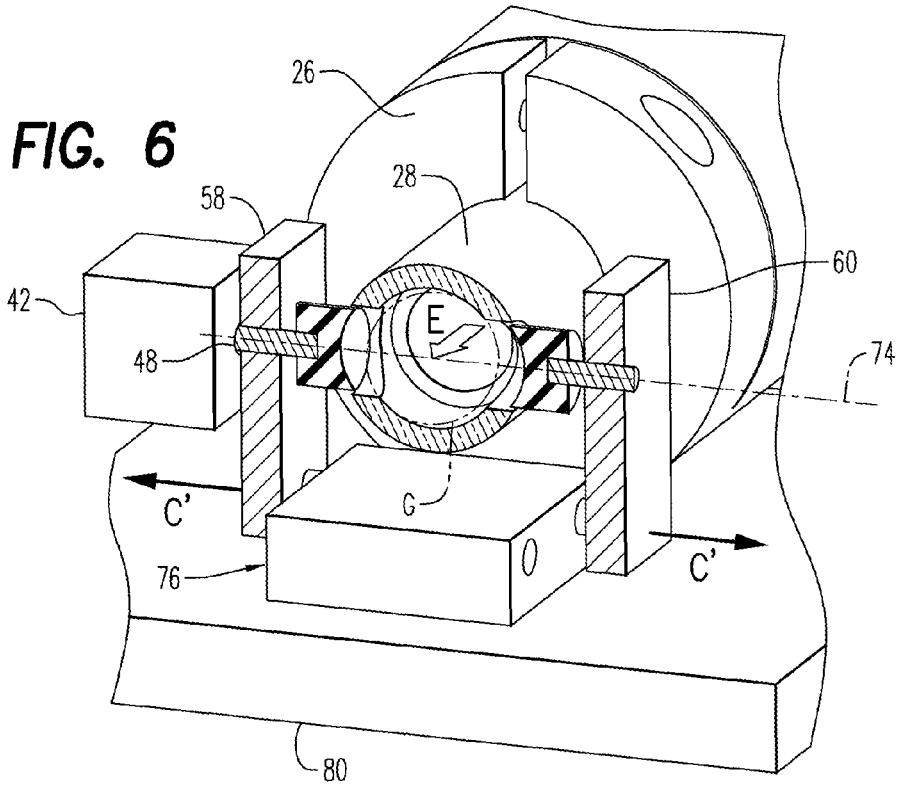
FIG. 6 is another view of FIG. 5.
Figure 7A:
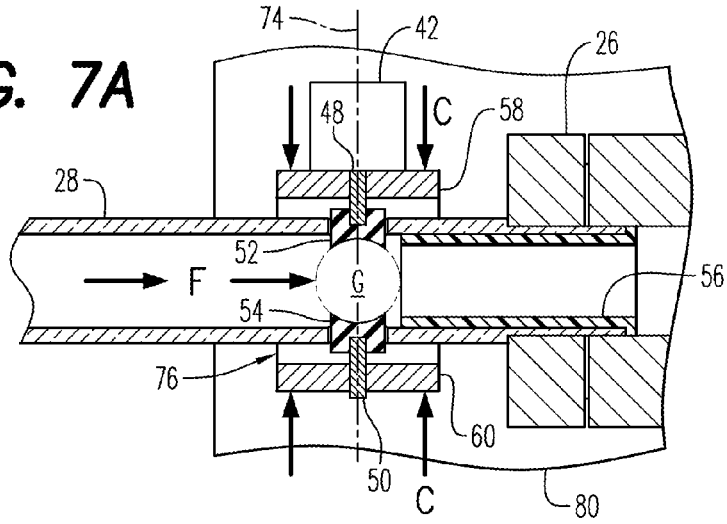
FIGS. 7A, B and C are top plan section views of FIGS. 5 and 6.
Figure 7B:
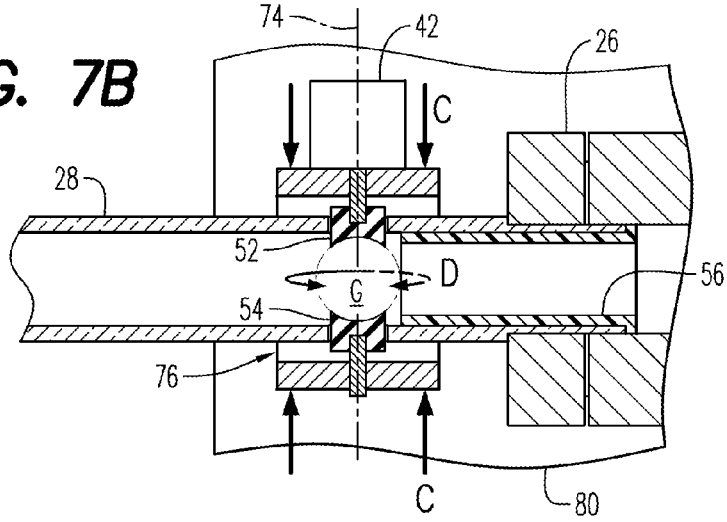

Referring now additionally to FIGS. 5, 6 and 7A, B and C, the functioning of the ball clamp assembly 76 which facilitates several important aspects of the present invention is there shown. As seen in FIG. 5, a golf ball G (shown in phantom) has been loaded into the barrel 28 from the open distal end, although alternate loading means are envisioned within the scope of this invention. The system controller circuit 36, in combination with pressurized air supplied to the ball clamp assembly 76 through air lines 44 and 46, causes the movable supports 58 and 60 to move inwardly toward one another in the direction of arrows C. Each of these supports 58 and 60 dependently hold rotatable servo spin shafts 48 and 50 therein in concentric alignment along the spin axis 74. Attached at each distal end of each of these spin shafts 48 and 50 are elastomeric golf ball support cups 52 and 54, each of which have concave opposing facing surfaces which match and align against the opposing spherical outer surface segments of the golf ball G.

A servomotor 42, again controlled by the controller circuit 36, causes the spin shaft and the driven golf ball support cup 52 to rotate in the direction of arrow D. Consequently, the free spinning golf ball support cup 54 and supportively connected rotating shaft 50 will also spin in unison with the golf ball G. Note that the spin direction may be in either direction as shown by arrow D about the spin axis 74. Moreover, by appropriate command input from the laptop computer 20, the spin rate of the golf ball G is also programmed into and through the system controller circuit 36.

Figure 7C:
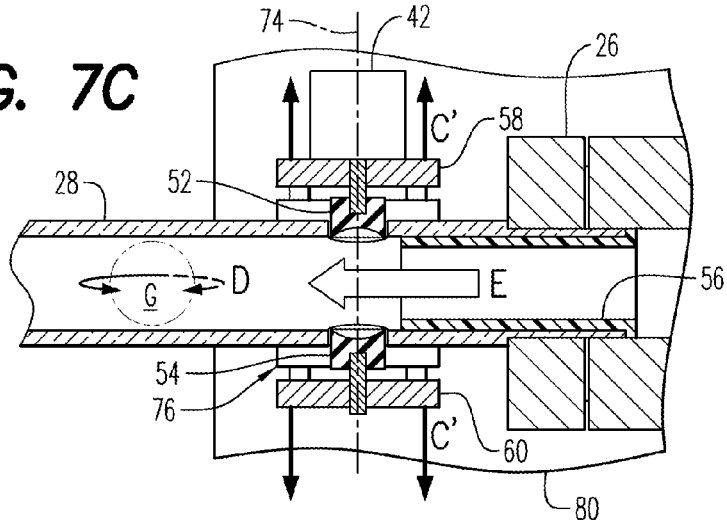

Once the desired spin rate and spin direction of the golf ball G have been achieved, two additional steps occur simultaneously as seen in FIG. 6. First, command signal from the controller circuit 36 causes the supports 58 and 60 to move outwardly in the direction of arrow C'. This causes the support cups 52 and 54 to become disengaged from an clear of the golf ball G. Then, again substantially simultaneously, the solenoid 24 causes an air charge to be released from the air tank 22 in a volume amount and at a pressure level controlled by the laptop computer 20. This discharge of pressurized air in the direction of arrow E causes the golf ball G to be launched from the barrel as best seen in FIG. 7C while still spinning in the direction of arrow D. Because suitable clearance is provided between the inner cylindrical surface of the barrel 28 and the outer diameter of the golf ball G, very little if any of the selected spin rate of the golf ball G is diminished.

Referring back to FIG. 3, a chronograph 72 is positioned immediately adjacent to the open distal end of the barrel and in close proximity along and aligned with the barrel axis 62 so as to accurately measure the velocity of the golf ball G as it exits the barrel 28. All data associated with each golf ball launching in this matter is then recorded on the laptop computer 20 for further statistical processing.

Set Up and Command Procedures

1. Level air cannon base to ground conditions.
2. Align air cannon barrel to target grid centerline.
3. Adjust air cannon barrel to proper launch angle.
4. Adjust chronograph position to be parallel to barrel.
5. Adjust side angle rotation of air cannon to create desired degree of hook or slice on golf ball.
6. Attach air line hose from air compressor to air cannon.
7. Adjust air regulator 38 to desired PSI pressure to generate desired golf ball speed.
8. Adjust air regulator 40 to ball clamping pressure of 20 PSI.
9. Attach communication cord from chronograph 72 to digital readout device.
10. Attach communication cable from air cannon to computer system 36.
11. Plug air cannon power cord into 110-120 V outlet.
12. Turn on computer 20 and open the golf2 software program.
13. Enter the desired golf ball spin rate into the goldf2 software.
14. Insert test golf ball G into cannon barrel 28.
15. Push activation button 82 on air cannon.

Air Cannon Smart Motor Interface Command Lines

16. Once the activation button 82 has been pressed on the cannon a series of commands are performed by the Smart Motor Interface Program.
    a. The air clamp 76, solenoid valve 24 and servomotor 42 are all integrated and programmed.
    b. The first command allows the air clamp 46 to move inward to grasp the golf ball G.
    c. The next command tells the servomotor 42 to begin spinning.
    d. The next command comes from the golf2 software informing the servomotor 42 to accelerate the ball spinning until it reaches the desired spin rate.
    e. The next command tells the servo 42 to hold the speed at the desired spin rate for 5 seconds.
    f. The next two commands tell the solenoid valve 24 to open to allow the air to be released from the tank 22 onto the golf ball G.
    g. Within a millisecond of the previous command a new command tells the air clamp 76 to relax the pressure on the golf ball G.
    h. The ball G is then hit with a significant blast of air pushing it up the barrel.
    i. Once the golf ball G has been pushed away from the air clamp 76 a new command is sent to the air clamp 76 to open to original position.
    j. A final command is then sent to restart the sequence for the next shot.
17. The ball speed is recorded with the with the chronograph 72 as it exits the air cannon barrel 28 and that is recorded.
18. Record the carry distance, total distance, carry off line from center and total distance offline of each golf ball shot.

While a number of exemplary aspects and embodiments have been discussed above, those of skill in the art will recognize certain modifications, permeations and additions and subcombinations thereof. It is therefore intended that the following appended claims and claims hereinafter introduced are interpreted to include all such modifications, permeations, additions and subcombinations that are within their true spirit and scope.

The invention claimed is:

1. A golf ball flight testing system for evaluating the flight characteristics of a golf ball comprising:

an air cannon apparatus including:

an elongated tubular barrel having an open distal end and being disposed along a longitudinal axis thereof, said barrel sized to slidably receive a golf ball therein;

an air pressure tank for storing pressurized air and being sealingly coupled to a proximal end of said barrel by an air control valve;

a golf ball air clamp assembly for holding a golf ball for rotation about a horizontal spin axis within said barrel adjacent said proximal end about a horizontal spin axis;

a servomotor coupled to said air clamp assembly for controlledly spinning the golf ball held within said air clamp assembly at a selected spin rate about the spin axis which passes concentrally through said air clamp assembly and the golf ball;

said air control valve controlledly releasing a charge of pressurized air from said air pressure tank into the proximal end of said barrel against the golf ball after said servomotor controlledly spins the golf ball to the selected spin rate, said air clamp assembly controlledly releasing the golf ball simultaneously with the releasing of the charge of pressurized air whereby the golf ball is launched from said barrel;

a frame assembly connected to and supporting said air cannon apparatus for lockable positioning of the barrel axis at a selected inclination angle of said barrel before launching the golf ball;

a controller for regulating air pressure to said air pressure tank and said air clamp assembly, said controller also regulating the spin rate of said servomotor and the opening and closing of said air control valve;

said air cannon apparatus being selectively rotatably positionable in said frame assembly about the barrel axis to selectively vary the orientation to horizontal of the spin axis.

* * * * *